US005443221A

United States Patent [19]

Petry

[11] Patent Number: 5,443,221

[45] Date of Patent: Aug. 22, 1995

[54] TAKE-OUT ARBOR FOR A STRIP ACCUMULATOR

[75] Inventor: David P. Petry, Columbia Station, Ohio

[73] Assignee: Kent Corporation, North Royalton, Ohio

[21] Appl. No.: 80,916

[22] Filed: Jun. 22, 1993

[51] Int. Cl.[6] ..... B65H 75/02

[52] U.S. Cl. ..... 242/364.1

[58] Field of Search ..... 242/364, 364.1; 226/118, 119

[56] References Cited

U.S. PATENT DOCUMENTS

| | | | |
|---|---|---|---|
| 3,310,255 | 3/1967 | Sendzimir | 242/364.1 |
| 3,885,748 | 5/1975 | Costello et al. | 242/55 |
| 4,506,841 | 3/1985 | Hood | 242/55 |
| 4,529,140 | 7/1985 | Cooper et al. | 242/364.1 |
| 4,557,427 | 12/1985 | Johnson | 242/364.1 |

OTHER PUBLICATIONS

"Supercoil Accumulator", Guild International, Inc., 7273 Division Street, Bedford, Ohio 44146; 6 pages; undated.

"Guild Model CCA Continuous Coil Spiral Accumulator", Guild International, Inc., 7273 Division Street, Bedford, Ohio 44146-5490; 2 pages; undated.

"FLOOP Free Loop Strip/Accumulators", Kent Corporation, 9941 York Theta Dr., North Royalton, Ohio 44133; 2 pages; undated.

"H-COIL Horizontal Accumlator", Kent Corporation, 9941 York Theta Dr., North Royalton, Ohio 44133; 2 pages; undated.

*Primary Examiner*—John M. Jillions

*Attorney, Agent, or Firm*—Renner, Kenner, Greive, Bobak, Taylor & Weber

[57] ABSTRACT

A take-out arbor (35) for receiving strip material (S) in a strip accumulator (20, 26) of a strip processing line includes a main mandrel (36) and a secondary mandrel (37) carried by the main mandrel (36). A plurality of rollers (67) are carried by the mandrels (36, 37), one end of each roller (67) being supported by the main mandrel (36) and the other end of each roller (67) being supported by the secondary mandrel (37). The main mandrel (36) is pivotally mounted to a frame (27 or 87) of the accumulator (20 or 26), and when the mandrels (36, 37) are pivoted, the secondary mandrel (37) rotates with respect to the main mandrel (36) such that the other end of each roller (67) pivots with respect to the one end of each roller (67) to align the rollers (67) with the strip material (S). The take-out arbor (35) can be utilized with both a vertically oriented accumulator (20) and a horizontally oriented accumulator (26). When operating in a horizontally oriented accumulator (26), the strip material (S) leaves the accumulator (26) with its edge parallel to the floor, traveling in the same direction that it was received by the accumulator (26). The strip material (S) may then be provided to a turnaround assembly (91) which redirects the strip material (S) to the processing line in a different direction back over the top of the accumulator (26).

31 Claims, 9 Drawing Sheets

TAKE-OUT ARBOR FOR A STRIP ACCUMULATOR

TECHNICAL FIELD

This invention relates to a take-out arbor which can be utilized in a vertically or horizontally oriented strip accumulator, as used in a continuous strip processing line. More particularly, this invention relates to an angularly mounted take-out arbor having rolls thereon, the angularity of both the arbor and the rolls being adjustable so that the center line of the strip material, regardless of its width, is maintained at the same position as it exits the accumulator to the processing line.

BACKGROUND ART

Many industrial processing lines utilize a strip material, such as a metallic strip material, as an input and require that the strip be continually fed thereto. As a practical matter, the strip is payed out from a coil until depleted. Because it would be highly undesirable to stop the processing line upon each depletion of a coil, vertically oriented strip accumulators, such as that shown in U.S. Pat. No. 3,506,210, have been developed to receive strip from the input coil and hold or store a quantity of the same while at the same time paying out strip so held to the processing line. Such accumulators thus utilize the strip stored therein to permit the processing line to remain active during the time a new input coil is attached, as by welding, to the end of a coil which has just been depleted.

Often times it is possible that the processing line will utilize strips of varying widths throughout the normal working day or week. When a change of strip width is desired, using the type of accumulator of U.S. Pat. No. 3,506,210, a major alignment problem exists. Essentially all strip processing lines are designed to receive strip material along the center line of the width thereof. Thus, the strip which exits the accumulator must exit at a point such that the center line of the width of the strip is in line with the processing equipment. In order to accomplish this requirement, accumulators made in accordance with U.S. Pat. No. 3,506,210 dictate that the strip be fed thereto from the coil with the center line of the width of the coil at the proper position so that the strip will exit aligned with the processing equipment. This requires complex adjustments of the position of the coil each and every time the coil width is changed to assure that the coil is properly centered with respect to the accumulator. While adjustable uncoilers are available for this purpose, they are quite expensive and often prove difficult and time consuming to properly adjust.

Because of these problems, vertically oriented accumulators have been provided with angularly mounted take-out arbors, the angle of which can be adjusted, with the intention that the center line of the strip material leaving the accumulator will always be at the same location no matter what the width of the strip material. Such a device is shown in U.S. Pat. No. 3,885,748. As shown in that patent, the angularly mounted arbor carries a plurality of roll clusters, each of which consist of a plurality of small aligned rollers. The strip material rides on these rollers in a helical path around the arbor, and the angle of the arbor is adjustable to maintain the center of the strip in the same location irrespective of its width.

While accumulators having the adjustable arbor of U.S. Pat. No. 3,885,748 have been quite successful and a mainstay in the industry, they are not without their problems. Since the rollers of the roll clusters are fixed to the arbor, when it is angularly adjusted, the strip does not track at exactly 90° to the rollers. This can cause the strip material to drift slightly from its intended course, which drifting not only can slightly misalign the center of the strip from its intended course, but can also scuff or otherwise mar the strip material as it tends to slide along the edges of the rollers. While such could be eliminated by manually adjusting the angle of each of the rollers in each of the several roll clusters to conform to the angle of the arbor each time the arbor is adjusted, such would be so time consuming so as not to be at all practical.

More recently, horizontally oriented accumulators have begun to become popular. In these devices, rather than have an arbor extending outwardly from a vertically oriented frame, the arbor extends upwardly from a horizontally oriented frame. The take-out arbors currently being employed for this type of equipment are highly unacceptable. The strip material exiting from these arbors has its flat, width dimension vertical and is moving upwardly. In order to be received by the processing line, the strip must have its flat, width dimension parallel to the floor and thus it must be twisted 90°. In order to accomplish this twist, a linear distance is required, which can be substantial and which is dependent on the width and thickness of the material. As the arbors of this equipment direct the material upwardly, the elevation of the material path is greatly increased. Since the material cannot be twisted until it has reached its peak, and since the material path cannot be altered due to its angularity to the floor, much valuable floor space is utilized to allow the strip to first move upwardly and then be twisted for proper orientation with the processing line.

Thus, the need exists for an arbor which can be utilized both for a vertical accumulator and a horizontal accumulator, and which can solve the problems existing in both types of devices.

DISCLOSURE OF THE INVENTION

It is thus an object of the present invention to provide an adjustable take-out arbor for a strip accumulator so that various widths of strip material exiting the accumulator will always be properly aligned with the processing equipment being served by the accumulator.

It is another object of the present invention to provide a take-out arbor, as above, which is angularly mounted on the accumulator and which carries guide rollers, both the arbor and the rollers being adjustable to vary the angular position of the arbor and the rollers relative to the accumulator.

It is a further object of the present invention to provide a take-out arbor, as above, which does not require any separate manual adjustment of the rollers on the arbor.

It is yet another object of the present invention to provide a take-out arbor, as above, which will not scuff, mar, or otherwise damage the strip material.

It is an additional object of the present invention to provide a take-out arbor, as above, which can be utilized on both vertically oriented and horizontally oriented strip accumulators.

It is a still further object of the present invention to provide a take-out arbor, as above, in which, when utilized with a horizontal strip accumulator, the strip material will not exit the accumulator moving upwardly thereby allowing the strip material to be twisted without utilizing valuable floor space.

These and other objects of the present invention, which will become apparent from the description to follow, are accomplished by the improvements hereinafter described and claimed.

In general, apparatus for accumulating strip material in a processing line includes a support member having a take-out arbor made in accordance with the present invention pivotally mounted thereon. The arbor receives the strip material on a plurality of rollers mounted on the arbor. Means are provided to pivot the arbor relative to the support member while at the same time pivoting the rollers relative to the arbor. More specifically, the arbor includes a first mandrel and a second mandrel carried by the first mandrel. The first mandrel is pivotally mounted on a pivot point. The roller assemblies are supported on the mandrels, one end of each roller assembly being supported by the first mandrel and the other end of each roller assembly being supported by the second mandrel. When the mandrels are being pivoted on the pivot point, the second mandrel rotates relative to the first mandrel such that the other end of each roller assembly pivots with respect to the one end of each roller assembly to align the roller assemblies with the strip material.

The take-out arbor can be utilized both in a vertically oriented and a horizontally oriented strip accumulator, each of which receive the strip material and form an outer set of convolutions thereof which feed an inner set of convolutions thereof. The strip material travels from the inner set of convolutions and around the take-out arbor which is mounted in the accumulator so that its axis is angular to the path of the strip material being received from the inner set of convolutions. The strip thus leaves the arbor and the accumulator with its width center line in proper alignment with the processing line.

When operating in a horizontally oriented accumulator, the strip material leaves the arbor with its edge parallel to the floor, with its width dimension in a plane perpendicular to the floor, and traveling in the same direction that it was received by the accumulator. The strip may then be provided to a turnaround assembly which redirects the strip material to the processing line in a different direction.

A preferred exemplary take-out arbor, shown as being usable for both vertically or horizontally oriented strip accumulators and incorporating the concepts of the present invention, is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
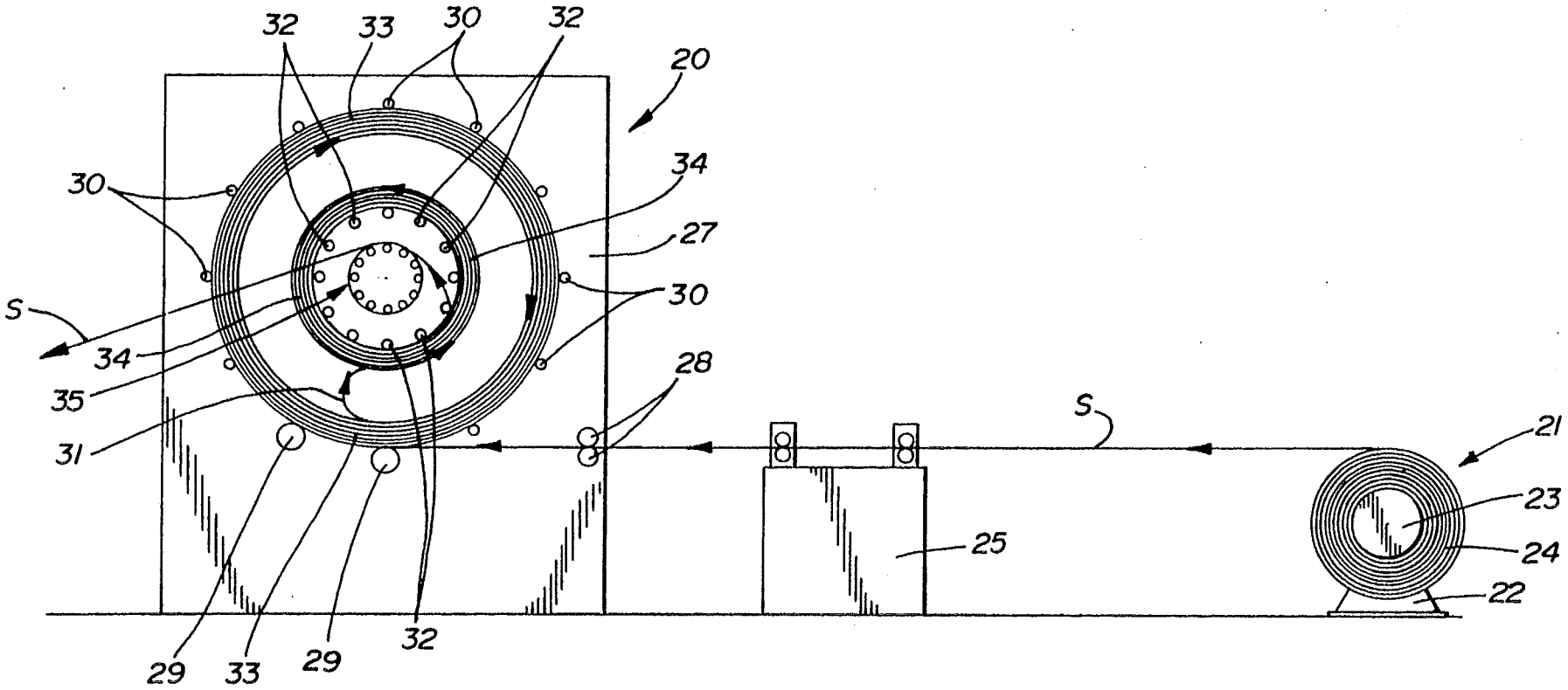
FIG. 1 is a schematic elevational view of a vertical strip accumulator having a take-out arbor made in accordance with the concepts of the present invention and shown with a strip end joiner and uncoiler which form a typical environment for the strip accumulator.

An accumulator having the novel features of the present invention is depicted schematically in FIG. 1 and indicated generally by the numeral 20. A typical environment for accumulator 20 includes an uncoiler, indicated generally by the numeral 21, which has a base 22 and axle 23 upon which a coil 24 of strip material S revolves. Various types of uncoilers exist, and the specific style utilized is unimportant to this invention. The strip S which may be of any material and gauge, but which is generally of a metallic material, can be fed through the jaws of an end joiner 25 to accumulator 20. End joiner 25, which can be a welding device, is used to join the end of a coil of strip just depleted to a fresh coil placed on uncoiler 21. Alternately, rather than being permanently in line with the strip passing therethrough, end joiner 25 may be a portable device which is brought in line only when needed.

The accumulator 20 shown is generally of the type known as a vertical accumulator such as that depicted in detail in U.S. Pat. No. 3,506,210, to which reference is made for whatever details might be necessary to fully understand the operation thereof; however, the invention described herein is capable of operating with any type of accumulating device, many of which are well known in the art, such as the horizontal accumulator shown in FIGS. 9 and 10 and indicated generally by the numeral 26.

As schematically shown in FIG. 1, accumulator 20 includes a generally vertically upstanding rear face or frame 27 which extends upwardly from floor F (FIG. 3) and carries essentially all of the elements of accumulator 20. A plurality of drive wheels 28, when activated, pull the strip S from uncoiler 21 and into accumulator 20. Usually the uncoiler or other device includes an alignment device, such as an edge guide (not shown) for presenting the strip S to the accumulator at a particular position or reference point. While the accumulator 20 of the present invention can advantageously receive strip S of any width with only one edge thereof aligned against such a guide, it is to be understood that the strip S may also be fed to accumulator 20 centered, if that is desired.

The strip is then transferred past guide and support rollers 29, which may also be driven or which may be driven instead of wheels 28, to form an outer loop of strip material, the outer edge of which is defined by a plurality of outer basket rollers 30. The material travels around the other basket rollers 30 and forms a free loop 31 as it is turned toward a series of rollers 32 which together form an inner basket or loop of strip material. In order to perform its storing function, at least initially and until accumulator 20 is filled to capacity, the speed of the strip S into the accumulator 20 is generally faster than the speed of the strip out of the accumulator to the processing line. Thus, outer convolutions 33 of strip S are accumulated with strip being continually fed to the outside thereof, and inner convolutions 34 of strip S are accumulated by receiving strip from the inside of the outer convolutions 33 by means of the orbiting of loop 31.

Upon demand from the processing line, which demand is almost always continual, the strip on the inside of the inner convolution 34 is transferred around a take-out arbor assembly, generally indicated by the numeral 35, and then transferred to the processing line. Regardless of the manner in which the strip is fed to the accumulator 20, that is, regardless of whether it is centered or placed against the edge guide, because of the construction of the arbor 35, to be described below, the strip will exit accumulator 20 at a reference point different than the reference point established by the edge guide, preferably centered to be received directly by the processing line.

Take-out arbor assembly 35 includes a main body portion or mandrel, generally indicated by the numeral 36, and a secondary body portion or mandrel, generally indicated by the numeral 37. As will hereinafter be described in detail, secondary mandrel 37 is rotatable relative to main mandrel 36, which is fixed relative to rotational movement, but both mandrels 36 and 37 are movable together angularly with respect to rear accumulator frame 27. Thus, arbor 35 is always mounted at an angle, other than 90°, to the path of the strip material S.

Figure 3:
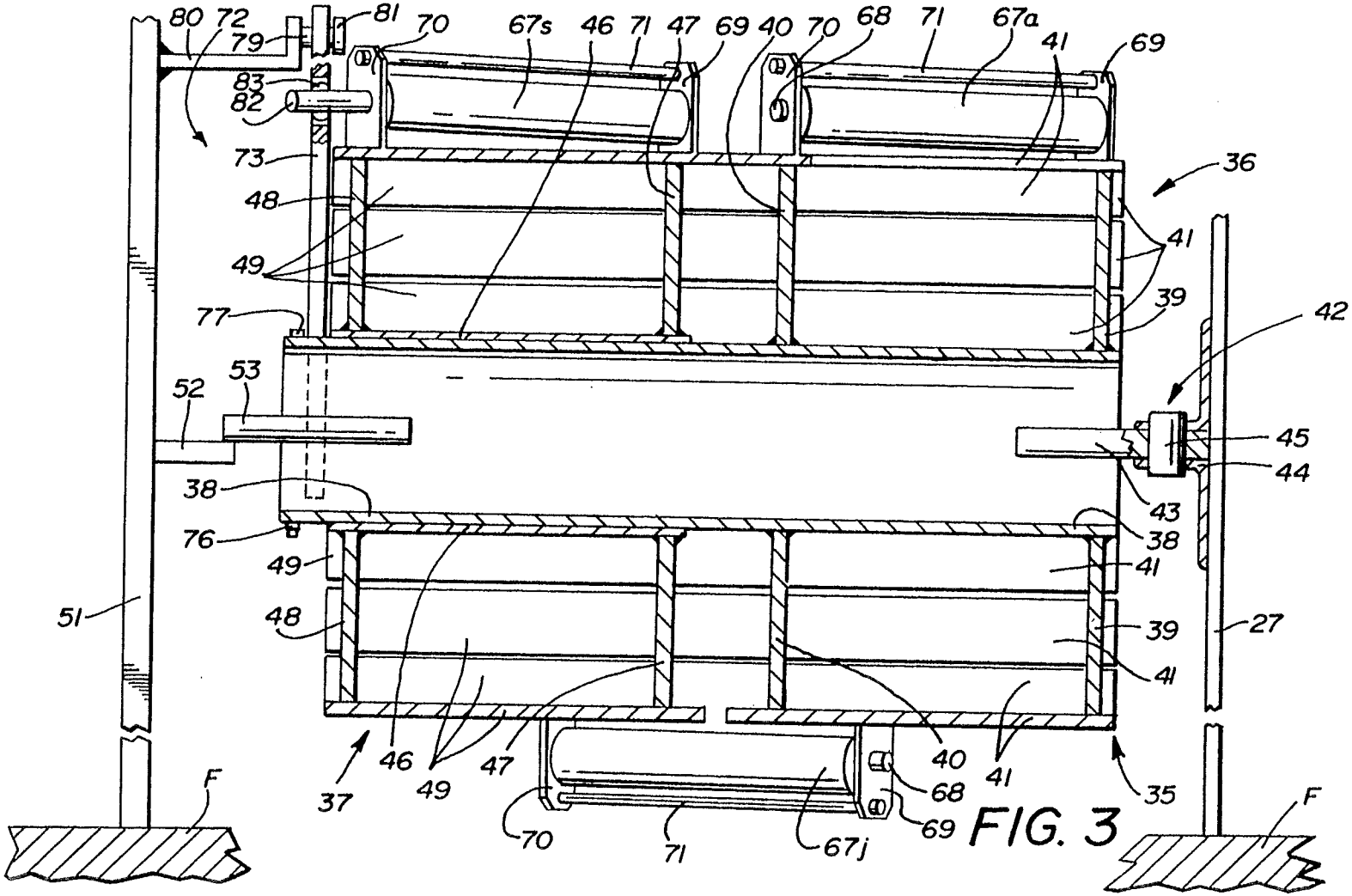
FIG. 3 is a fragmented sectional view taken substantially along line 3—3 of FIG. 2.
Figure 7:
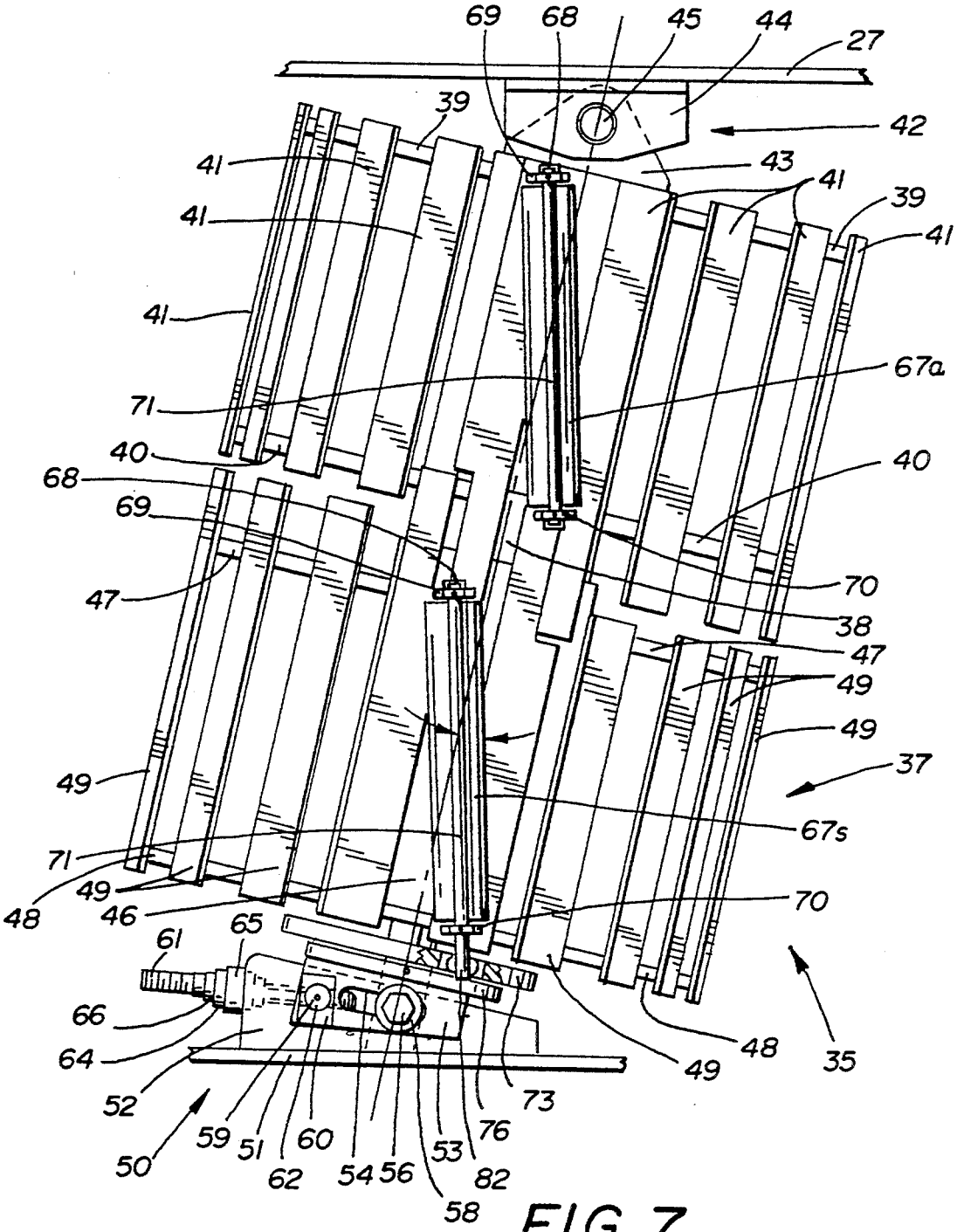
FIG. 7 is a somewhat schematic top plan view of the take-out arbor, similar to FIG. 2, but showing the arbor in a different, adjusted position.
Figure 8:
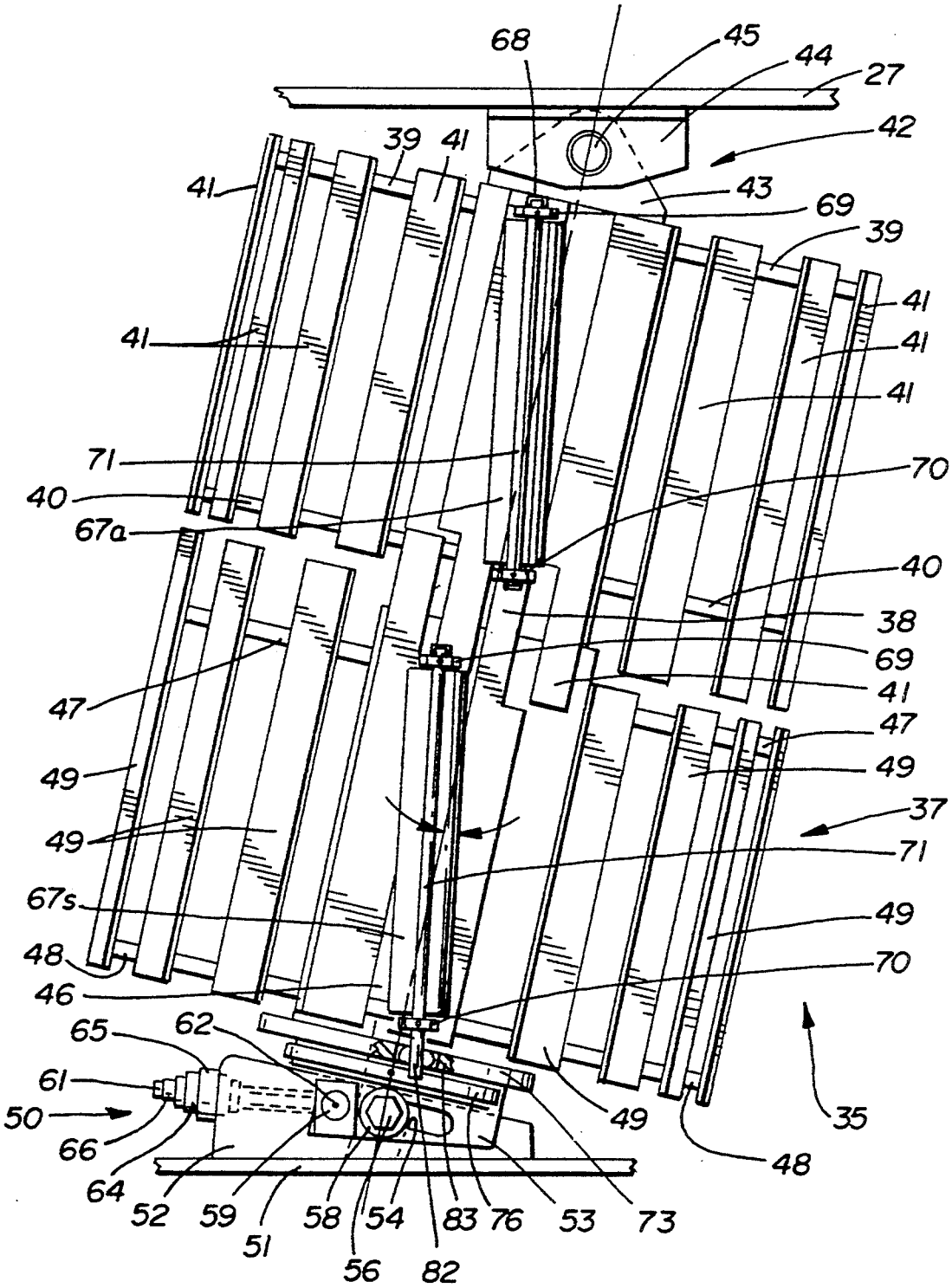
FIG. 8 is a somewhat schematic top plan view of the take-out arbor, similar to FIG. 7, but showing the arbor in a different, adjusted position.

As probably best shown in FIGS. 3, 7 and 8, arbor mandrel 36 includes a centrally located, hollow, cylindrical hub 38. A rear disk 39 and a front disk 40 are welded to the circumferential outside of hub 38 and are spaced from each other to carry a plurality of spaced slats 41. Together, slats 41 define a generally cylindrical outer shell for mandrel 36. While this outer shell could be continuous in nature, slats 41 are preferred not only to reduce the weight of arbor 35, but also, as can be seen particularly in FIGS. 7 and 8, because of the requirement that some slats 41 be longer than others for reasons to be hereinafter described.

Figure 2:
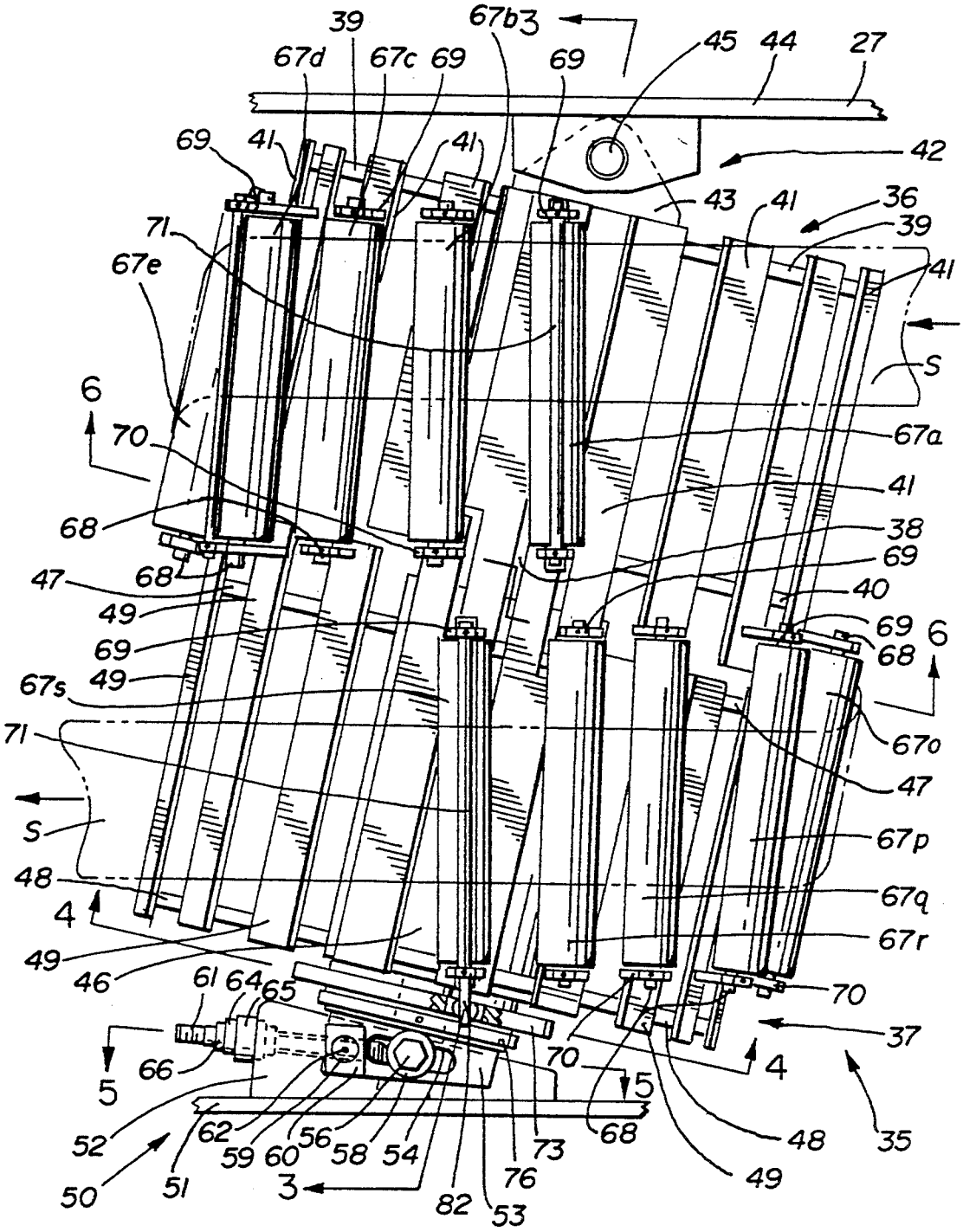
FIG. 2 is a top plan view of the take-out arbor.
Figure 4:
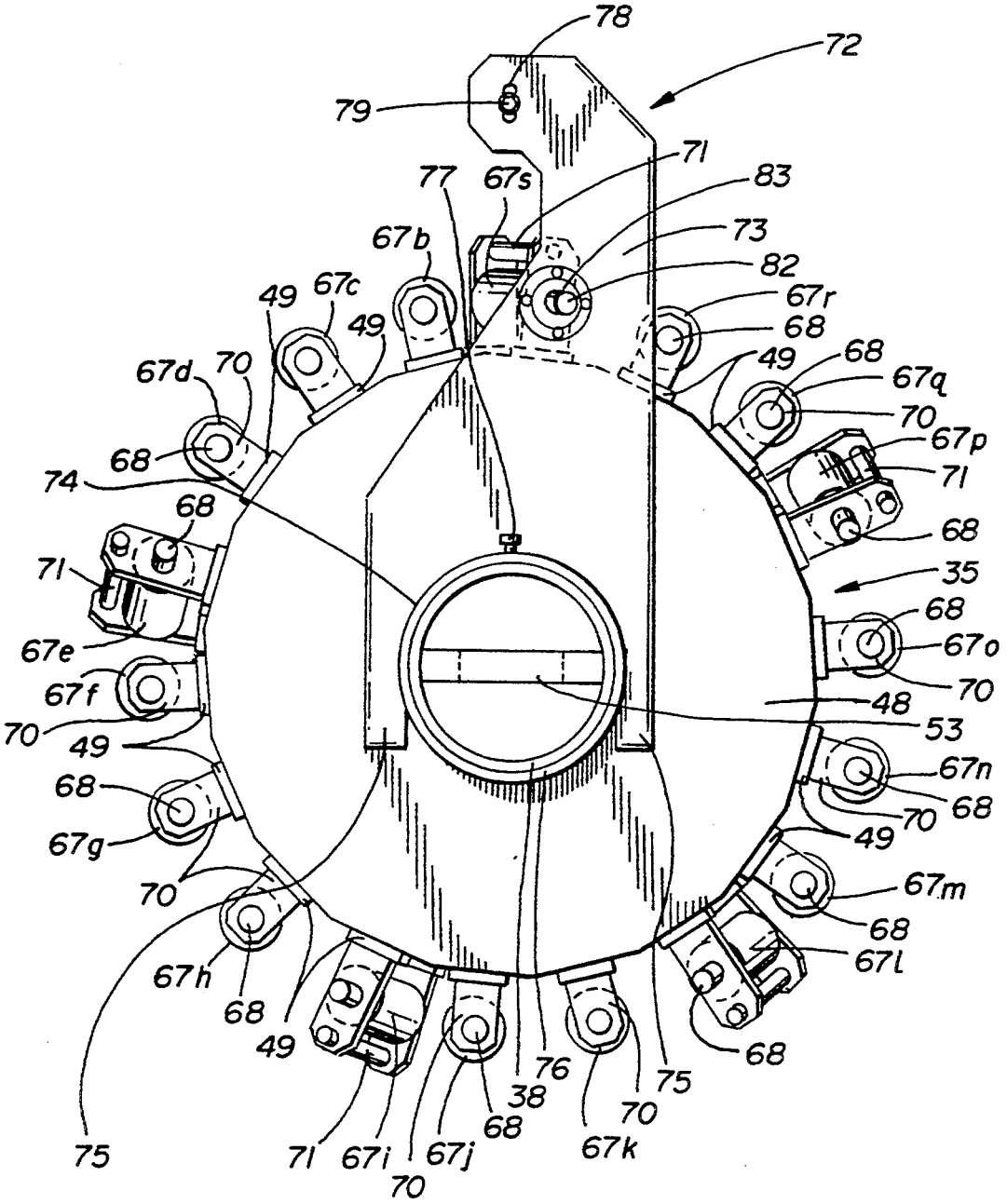
FIG. 4 is a somewhat schematic end elevational view of the take-out arbor taken substantially along line 4—4 of FIG. 2.
Figure 6:
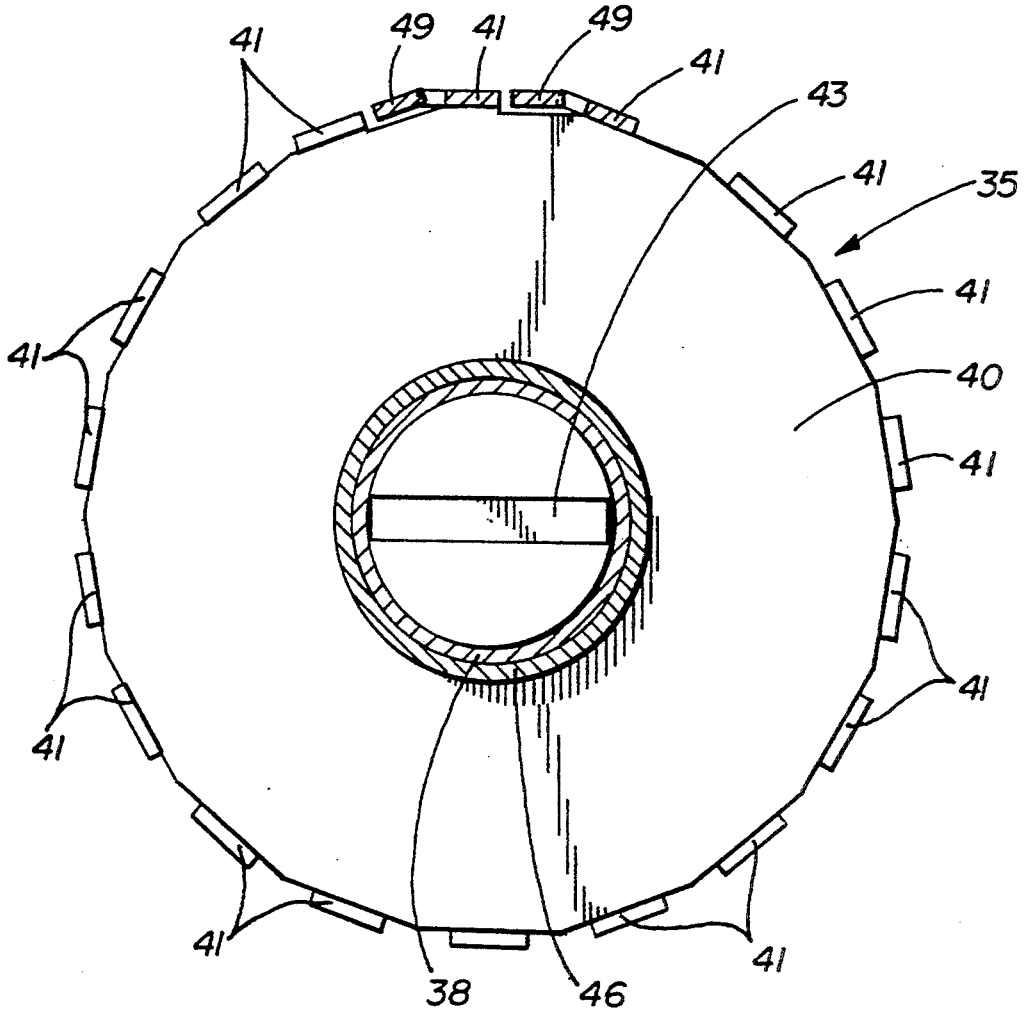
FIG. 6 is a sectional view taken substantially along line 6—6 of FIG. 2.

Main arbor mandrel 36 is attached to rear frame 27 by a pivot assembly generally indicated by the numeral 42. As shown in FIGS. 2, 4 and 6, pivot assembly 42 includes a clevis 43 welded to the interior of hub 38 and extending longitudinally outwardly thereof to be received by a trunion 44 carried by rear frame 27. A pivot pin 45 extends through clevis 43 and trunion 44, and arbor 35 is thus angularly adjustable with respect to frame 27 by rotation on an axis defined by pin 45.

Arbor mandrel 37 includes a centrally located, hollow, cylindrical hub 46 which is shorter than hub 38 of mandrel 36 and which, as best shown in FIG. 3, is slidably received around the outside of hub 38. Thus, when mandrel 36 is pivoted on pin 45, mandrel 37, and thus entire arbor 35, will be so pivoted. A rear disk 47 and front disk 48 are welded to the circumferential outside of hub 46 and are spaced from each other to carry a plurality of spaced slats 49. As was previously described with respect to slats 41 of arbor mandrel 36, together slats 49 define a generally cylindrical outer shell for mandrel 37. Like the outer shell of mandrel 36, such spaced slats 49 are preferred over a continuous shell to reduce the weight of arbor 35 and to easily accommodate the fact that some of the slats 49 need to be longer than others, as will be hereinafter described.

Figure 5:
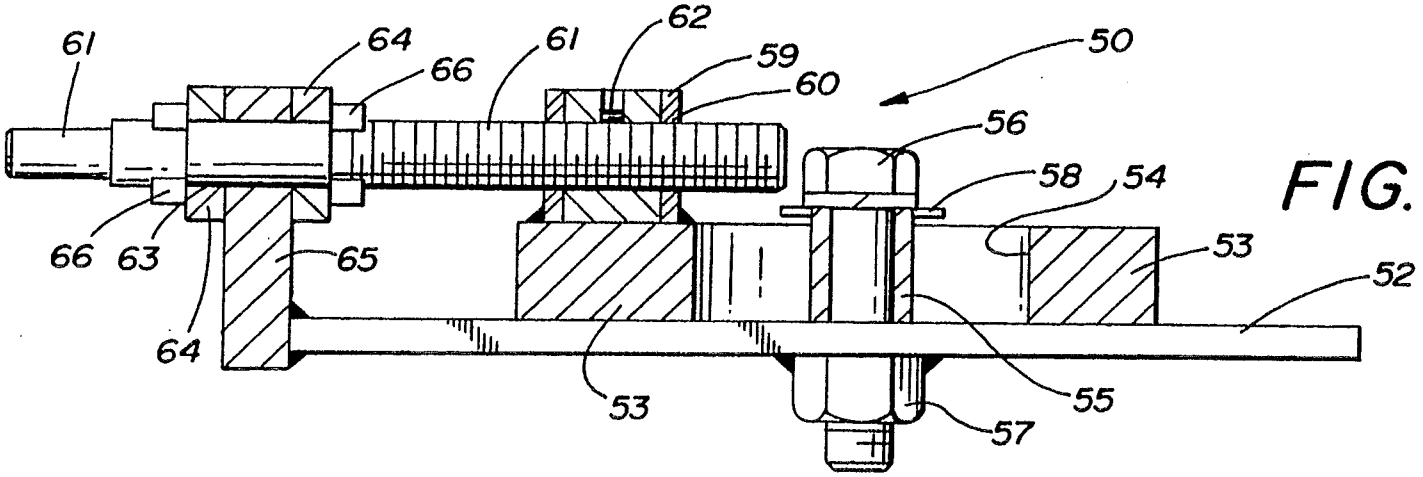
FIG. 5 is an enlarged sectional view taken substantially along line 5—5 of FIG. 2.

The manner in which mandrels 36 and 37 are pivoted on pin 45 is best described with reference to FIGS. 2 and 5 which show an adjustment assembly generally indicated by the numeral 50 and carried by a front, floor-mounted, vertically oriented frame 51 of accumulator 20 (not shown in FIG. 1 for clarity). Adjustment assembly 50 includes a base plate 52 which extends inwardly from frame 51 and slidably supports a plate 53 having a slot 54 therein. Plate 53 is attached, as by welding, to the inside of hub 46 of arbor mandrel 37 (FIG. 4). A guide bushing 55 extends through slot 54 and is held in place by a bolt 56 having a nut 57 and washer 58. Bolt 56 may be welded to plate 52 to in effect make bushing 55 a permanent stud.

Plate 53 carries a generally cylindrical tube 59 having a radial threaded bore 60 therethrough to receive the threaded end of an adjusting bolt 61. A set screw 62 may be provided to hold bolt 61 in place and prevent undesired rotation thereof. The unthreaded end of bolt 61 is slidably received through a bore 63 and its associated thrust washers 64, bore 63 being formed in a block 65 carried by base plate 52. The relative position of block 65 and bolt 61 is maintained by lock collars 66.

In order to adjust the angularity of arbor 35, for example, from the generally central or neutral position shown in FIG. 2 to one of the other positions shown in FIGS. 7 or 8, with set screw 62 loosened, rotation of bolt 61 will cause tube 59 to move along the threads thereof. Accordingly, plate 53 will move with respect to base plate 52, slot 54 traversing along bushing 55. Because plate 53 is attached to hub 46 of arbor mandrel 37, which is, in turn, carried by arbor mandrel 36, the entire arbor 35 is pivoted on pin 45. Thus, as shown in FIG. 7, arbor 35 has been pivoted clockwise from the FIG. 2 position to adjust the angle thereof relative to the path of the strip S and relative to frame 27, and as shown in FIG. 8, arbor 35 has been pivoted counterclockwise from the FIG. 2 position to adjust the angle thereof in the other direction. By establishing the FIG. 2 central or neutral position to accommodate the average or median strip S widths, smaller and larger strip S widths can be readily received around arbor 35, having been fed to accumulator 20 with a fixed edge, irrespective of the width, but leaving arbor 35 and accumulator 20 with its width center line fixed—all as more fully described in U.S. Pat. No. 3,885,748 to which reference is made, as necessary, for a complete understanding of this invention.

As shown, the actual angle adjustment is not great, but does achieve the desired results. For example, assuming a median setting to accommodate a strip S width of 8.25 inches, arbor 35 is preferably positioned at an angle relative to perpendicular to frame 27 of approximately 12.27° (FIG. 2). For a strip width of about 1.5 inches, arbor 35 is positioned at an angle of approximately 13.93° from perpendicular (FIG. 7), and for larger strip S widths, such as 15 inches, the angle is reduced to approximately 10.62° from perpendicular (FIG. 8). Thus, rotation of arbor 35 of less than 3.5° is sufficient to accommodate strip S widths of from 1.5 inches to 15 inches.

No matter what the strip S width, strip S passes around arbor 35 in a helical path, as now will be described. Arbor mandrels 36 and 37 carry a plurality of roller assemblies mounted on slats 41 and 49 in a helical path therearound. Each roller assembly includes a roller 67, and ideally the longitudinal direction of each roller 67 should be maintained perpendicular to the path of the strip and thus is approximately 12.27° from the axis of arbor 35 in the median or neutral position. Thus, as shown in FIG. 2, when strip S moves onto arbor 35 in the direction shown by the arrow, it encounters the first roller 67*a* on the top of arbor 35 and sequentially passes over rollers 67*b–s*, which are mounted in a helical path around arbor 35, until it exits at the top of arbor 35, as shown in FIG. 2. It should be noted that only rollers 67*e*, 67*j*, 67*i*, 67*p*, and 67*s* are shown in FIG. 4 as they would actually appear, that is, angularly mounted, with the rest of the roller assemblies being schematically shown for clarity.

Each roller 67 is mounted for rotation on a shaft 68 rotatably carried between a rear bracket 69 and a front bracket 70. Each rear bracket 69 is mounted on a slat 41 of mandrel 36 and each front bracket 70 is mounted on a slat 49 of mandrel 37. Thus, the rear longitudinal extent of each roller 67 is carried by mandrel 36, and the front longitudinal extent of each roller 67 is carried by mandrel 37. In order to mount rollers 67 in the desired path, some of the slats 41 and 49 must be longer than other of the slats 41 and 49, as previously described. For example, the slats 41 carrying the rear brackets 69 for rollers 67*r* and 67*s* are longer than other of the slats 41, and the slats 49 carrying the front brackets 70 for rollers 67*a* and 67*b* are longer than other of the slats 49. Such can be clearly seen in FIGS. 7 and 8 where the majority of the rollers have been omitted for clarity. At least some of the roller assemblies may be provided with containment bars 71 extending between brackets 69 and 70 and thus running parallel to rollers 67. At start up, the strip S is threaded between rollers 67 and bars 71 to assure that the strip S maintains contact with the rollers 67 as it traverses arbor 35.

Were it not for the fact that one end of each roller assembly is mounted on arbor mandrel 36 and the other end on arbor mandrel 37, when the angle of arbor 35 is adjusted, as previously described, the rollers 67 would not be properly oriented in total alignment with strip S. However, because of such mounting, proper alignment is maintained by a roller adjusting assembly, generally indicated by the numeral 72, best shown in FIG. 4, and now to be described.

The main component of roller adjusting assembly 72 is a fork 73 which has an arcuate slot 74 near the bottom thereof which is received around and rides on the outer end of hub 38 of arbor mandrel 36. Spade members 75 extend tangentially downward along the sides of hub 38, and fork 73 is maintained axially on hub 38 by a retaining ring 76 which is held in place as by a set screw 77. A generally oval slot 78 is formed near the top of fork 73 to receive a pin 79 that extends outwardly from a flange 80 (FIG. 3) mounted on front frame 51. An enlarged head 81 on pin 79 maintains fork 73 on pin 79 between flange 80 and head 81.

The shaft 68 of one of the rollers, for example, roller 67*s*, is extended, as at end 82, through its front bracket 70. Shaft end 82 extends through spherical bearings 83 positioned in the body of fork 73 between hub 38 and pin 79. When arbor 35 is moved angularly relative to frame 27 by operation of adjustment assembly 50, as previously described, hub 38 translates, to the left or the right in FIG. 4, which correspondingly moves the bottom of fork 73. Fork 73 thus pivots on pin 79, the slot 78 holding pin 79 being oval to accommodate any slight vertical component of the movement of fork 73. The pivoting of fork 73 pulls, or pushes, shaft end 82 which thereby rotates hub 46 of arbor mandrel 37 relative to hub 38 of arbor mandrel 36, because the front end of roller 67*s*, and in fact all of the rollers, is attached to mandrel 37. As a result, the front mounting of all of the rollers 67 is slightly rotated relative to the back mounting thereof to properly and automatically align all of the rollers 67 with the strip S at the same time arbor 35 is moved angularly. Although this rotation is rather slight, to prevent any possible binding between brackets 69, 70 and shafts 68, brackets 69, 70 can be designed to have only point contact with shafts 68.

In short, by the simple operation of adjustment assembly 50, both the desired angular orientation of arbor 35 and the desired angular orientation of rollers 67 is accomplished. By way of actual settings, for the median width strip S, as described above, pin 79 is directly radially above hubs 38 and 46, and the point that the end 82 of shaft 68 extends through fork 73 is offset therefrom by approximately 7.92° (FIG. 4). For smaller strip S widths, the outer end of arbor 35 is moved to the right, as shown in FIG. 7, hub 46 having rotated approximately 3.09° clockwise as the angle shown in FIG. 4 becomes approximately 11.01°, thereby moving the front ends of all of the rollers to the left as viewed in FIG. 7. Similarly, for larger strip S widths, the outer end of arbor 35 is moved to the left, as shown in FIG. 8, hub 46 having rotated approximately 2.57° counterclockwise as the angle shown in FIG. 4 becomes approximately 5.35°, thereby moving the front ends of all of the rollers to the right as viewed in FIG. 8. Whether in the FIG. 2, 7 or 8 position, ideally the axes of all of the rollers are thus maintained as close as possible to perpendicular to frame 27.

It should thus be evident that when arbor 35 is positioned in a vertical accumulator 20 and it is desired to change the width of strip S being fed thereto, merely utilizing adjustment assembly 50 will not only properly orient the angle of the arbor 35 so that the strip S exits with its width center aligned with the processing line, but will also properly orient the angle of the rollers 67 mounted thereon so as to be in line with the path of the strip S.

Figure 9:
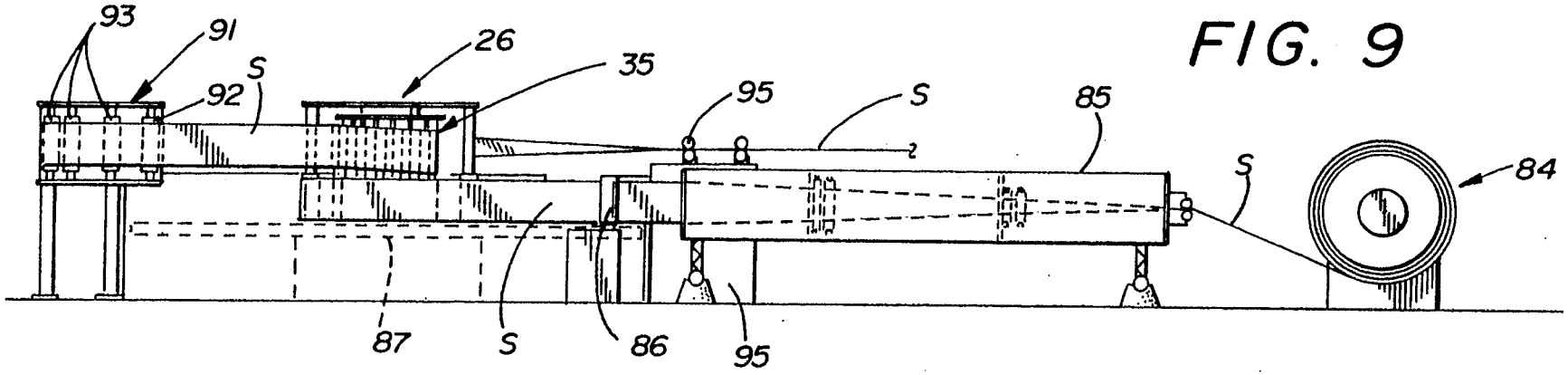
FIG. 9 is a schematic elevational view of a horizontal strip accumulator having a take-out arbor made in accordance with the concepts of the present invention and shown with an uncoiler, a strip entry twister, a unique turn-around system and a strip exit twisting stand which form the environment for the horizontal strip accumulator.
Figure 10:
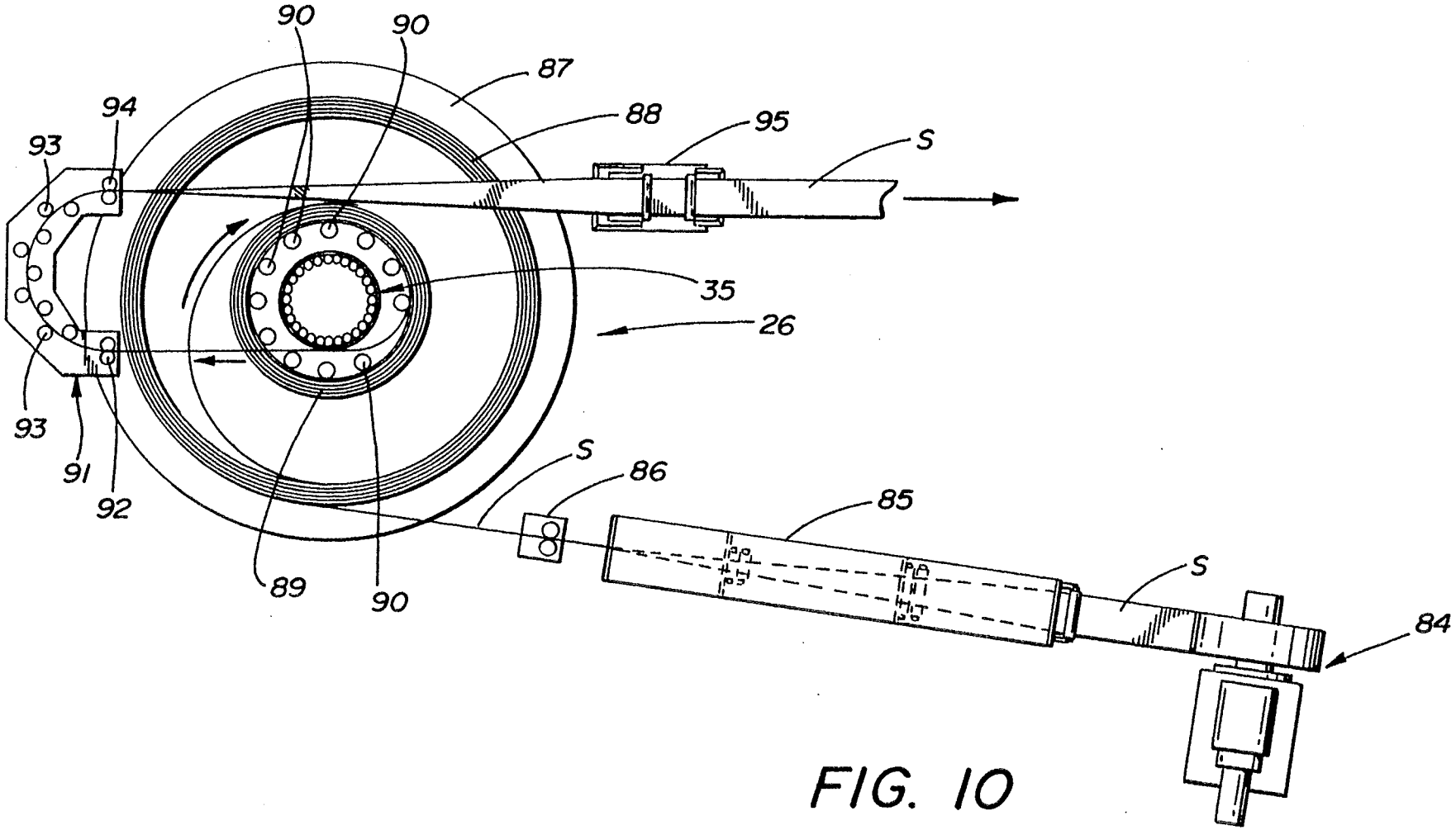
FIG. 10 is a schematic top plan view of the horizontal strip accumulator and its associated elements shown in FIG. 9.

The adjustable arbor provides even more improvements for the horizontal accumulator 26 shown in FIGS. 9 and 10. Accumulator 26 is depicted in the environment of a processing line which includes a conventional uncoiler 84, which can be identical to uncoiler 21. Uncoiler 84 provides strip S to a conventional strip entry twister 85 which turns strip S on its edge, that is, with its width dimension in a plane perpendicular to the floor. As so oriented, strip S passes through driven pinch rolls 86 and into accumulator 26.

In principle, accumulator 26 operates essentially identically to accumulator 20 except that basically all of its parts are oriented 90° to those in accumulator 20. Thus, rear frame 27 of accumulator 20 is replaced by a horizontally oriented base or table 87 which supports essentially all of the elements of accumulator 26. Strip S entering accumulator 26 forms outer strip convolutions 88, the strip on the inside of which is fed to inner strip convolutions 89 supported by rollers 90. The strip on the inside of convolutions 89 is transferred to and around arbor 35 which is adjustable identically as when it is used in accumulator 20.

Not only does arbor 35 thus provide its exiting strip S properly aligned, but is also particularly advantageous in a horizontal accumulator because the exiting strip S has its edge parallel to the floor as opposed to the rising exiting strip which has plagued conventional horizontal accumulators. Moreover, by use of arbor 35, strip S exits accumulator 26 traveling in the same direction as it was when it entered accumulator 26. At that point, that is, as strip S exits accumulator 26, it can be fed to a turnaround device 91 which includes entry rollers 92 and turnaround rollers 93 which direct strip S to exit rollers 94 and out in a different direction preferably back over the top of accumulator 26 as shown. Downstream from turnaround device 91 and back in the direction of uncoiler 84, a conventional exit twisting stand 95 may be provided to twist strip S 90° so that its width plane is parallel to the floor—its appropriate orientation for receipt by the processing line. It should thus be appreciated that the twisting can take place over the top of accumulator 26, thereby saving valuable floor space which would otherwise have been required to effect the twisting. Moreover, because strip S is not rising after it leaves accumulator 26, the twisting action can begin to take place immediately rather than waiting until the strip reaches its summit.

It should thus be evident that a take-out arbor made in accordance with the concepts of the present invention not only automatically provides strip material at its desired position for the processing, being guided around the arbor over adjustable rollers, but also can be utilized in both vertically oriented and horizontally oriented accumulators. When used in horizontal accumulators, a unique floor-saving system can be employed. The arbor, as well as the vertical and horizontal accumulators described herein, thus accomplish the objects of the present invention and otherwise substantially improve the strip processing art.

I claim:

1. A take-out arbor for receiving strip material in a strip accumulator comprising a first mandrel portion, means to mount said first mandrel portion on a pivot point, a second mandrel portion carried by said first mandrel portion, means to pivot said mandrel portions on said pivot point, a plurality of roller assemblies supported by said mandrel portions, one end of each said roller assembly being supported by said first mandrel portion and the other end of each said roller assembly being supported by said second mandrel portion, and means to rotate said second mandrel portion relative to said first mandrel portion so that as said mandrel portions are being pivoted on said pivot point, said other end of each said roller assembly pivots with respect to said one end of each said roller assembly.

2. A take-out arbor according to claim 1 wherein said first mandrel portion includes a hub member.

3. A take-out arbor according to claim 2 wherein said second mandrel portion includes a hub member slidably received over said hub member of said first mandrel portion.

4. A take-out arbor according to claim 2 wherein said means to mount includes a clevis carried by said hub member, a trunion carried by the accumulator, and a pivot pin received through said clevis and said trunion and defining said pivot point.

5. A take-out arbor according to claim 2 wherein said first mandrel portion includes disks carried by said hub member and slats carried by said disks, said slats carrying said one end of each said roller assembly.

6. A take-out arbor according to claim 5 wherein said second mandrel portion includes a hub member slidably received over said hub member of said first mandrel portion, disks carried by said hub member of said second mandrel portion, and slats carried by said disks of said second mandrel portion, said slats of said second mandrel portion carrying said other end of each said roller assembly.

7. A take-out arbor according to claim 1 wherein said means to rotate includes fork means carried by said first mandrel portion and pivotally connected to the accumulator, said fork means engaging said other end of at least one said roller assembly to rotate said second mandrel portion relative to said first mandrel portion when said mandrel portions are being pivoted on said pivot point.

8. A take-out arbor according to claim 7 wherein said first mandrel portion includes a hub member, one end of said fork means riding on said hub member so that when said mandrel portions are pivoted, said fork means moves with said mandrel portions.

9. A take-out arbor according to claim 8 wherein the pivotal connection between said fork means and the accumulator includes a pin member carried by the accumulator and a slot near the other end of said fork means, said slot receiving said pin member.

10. A take-out arbor according to claim 9 wherein each said roller assembly includes a first bracket mounted on said first mandrel portion, a second bracket mounted on said second mandrel portion, a roller shaft supported between said brackets, and a roller carried on said roller shaft, said fork means engaging said roller shaft of at least one of said roller assemblies.

11. A take-out arbor according to claim 10 wherein said roller shaft of said at least one of said roller assemblies extends through said fork means between said pin member and said hub member.

12. A take-out arbor according to claim 10 wherein at least some of said roller assemblies include a strip containment bar supported between said brackets and positioned adjacent and generally parallel to said rollers, the strip being positioned between each said roller and each said containment bar.

13. A take-out arbor according to claim 1 wherein said means to pivot includes a threaded bolt, the rotation of which pivots said mandrel portions.

14. A take-out arbor according to claim 13 wherein said means for pivot includes a base plate affixed to said second mandrel portion, a slide plate carried by said base plate, threaded means carried by said slide plate and threadably engaging said bolt, and block means carried by said base plate and slidably receiving said bolt therethrough.

15. A take-out arbor according to claim 14 wherein said means to pivot includes guide means carried by said base plate, said guide means being received through a slot in said slide plate to guide said slide plate as it moves on said base plate.

16. Apparatus for accumulating strip material in a processing line comprising means receiving the strip and forming an outer set of convolutions of the strip, means receiving the strip from the outer set of convolutions and forming an inner set of convolutions of the strip; arbor means receiving strip from the inner set of convolutions before the strip is transferred to the processing line; said arbor means having an axis which is angular to the path of the strip as received from the inner set of convolutions; and means to adjust the angularity of the axis of said arbor means with respect to the path of the strip to maintain the strip in line with the processing line; said arbor means including a first body portion, a second body portion carried by said first body portion, a plurality of roller assemblies each having one end supported on said first body portion and the other end supported on said second body portion, and means to rotate said second body portion relative to said first body portion so that as the axis of said arbor means is being adjusted, said other end of each said roller assembly pivots with respect to said one end of each said roller assembly.

17. Apparatus for accumulating strip material according to claim 16 wherein said first body portion includes a hub member.

18. Apparatus for accumulating strip material according to claim 17 wherein said second body portion includes a hub member slidably received over said hub member of said first body portion.

19. Apparatus for accumulating strip material according to claim 17 further comprising a support member, said means to adjust including a clevis carried by said hub member, a trunion carried by said support member, and a pivot pin received through said clevis and said trunion.

20. Apparatus for accumulating strip material according to claim 19 wherein said means to adjust includes a threaded bolt, the rotation of which pivots said body portions on said pivot pin.

21. Apparatus for accumulating strip material according to claim 20 wherein said means to adjust includes a base plate affixed to said second body portion, a slide plate carried by said base plate, threaded means carried by said slide plate and threadably engaging said bolt, and block means carried by said base plate and slidably receiving said bolt therethrough.

22. Apparatus for accumulating strip material according to claim 21 wherein said means to adjust includes guide means carried by said base plate, said guide means being received through a slot in said slide plate to guide said slide plate as it moves on said base plate.

23. Apparatus for accumulating strip material according to claim 16 wherein said first body portion includes a hub member, disks carried by said hub member and slats carried by said disks, said slats carrying said one end of each said roller assembly.

24. Apparatus for accumulating strip material according to claim 23 wherein said second body portion includes a hub member slidably received over said hub member of said first body portion, disks carried by said hub member of said second body portion, and slats carried by said disks of said second body portion, said slats of said second body portion carrying said other end of each said roller assembly.

25. Apparatus for accumulating strip material according to claim 16 further comprising a support member, said means to rotate including fork means carried by said first body portion and pivotally connected to said support member, said fork means engaging said other end of at least one said roller assembly to rotate said second body portion relative to said first body portion when the angularity of the axis of said arbor means is being adjusted.

26. Apparatus for accumulating strip material according to claim 25 wherein said first body portion includes a hub member, one end of said fork means riding on said hub member so that when the angularity of the axis of said arbor means is being adjusted, said fork means moves with said body portions.

27. Apparatus for accumulating strip material according to claim 26 wherein the pivotal connection between said fork means and said support member includes a pin carried by said support member and a slot near the other end of said fork means, said slot receiving said pin.

28. Apparatus for accumulating strip material according to claim 27 wherein each said roller assembly includes a first bracket mounted on said first body portion, a second bracket mounted on said second body portion, a roller shaft supported between said brackets, and a roller carried on said roller shaft, said fork means engaging said roller shaft of at least one of said roller assemblies.

29. Apparatus for accumulating strip material according to claim 28 wherein said roller shaft of said at least one of said roller assemblies extends through said fork means between said pin and said hub member.

30. Apparatus for accumulating strip material according to claim 27 wherein at least some of said roller assemblies include a strip containment bar supported between said brackets and positioned adjacent and generally parallel to said rollers, the strip being positioned between each said roller and each said containment bar.

31. Apparatus for accumulating strip material in a processing line comprising a support member, an arbor receiving the strip material and pivotally mounted on said support member, a plurality of rollers supported on said arbor, and means for pivoting both said arbor relative to said support member and at the same time for pivoting said rollers relative to said arbor.

* * * * *